US008855260B2

(12) United States Patent
Argoud

(10) Patent No.: US 8,855,260 B2
(45) Date of Patent: Oct. 7, 2014

(54) DEVICE FOR THE TRANSPORTATION OF NUCLEAR FUEL AND METHOD FOR LOADING/UNLOADING OF THE SAID DEVICE

(75) Inventor: Jean-Claude Argoud, Montbonnot (FR)

(73) Assignee: Commissariat a l'Energie Atomique, Paris (FR)

( * ) Notice: Subject to any disclaimer, the term of this patent is extended or adjusted under 35 U.S.C. 154(b) by 1164 days.

(21) Appl. No.: 12/447,790

(22) PCT Filed: Nov. 6, 2007

(86) PCT No.: PCT/EP2007/061944

§ 371 (c)(1),
(2), (4) Date: Dec. 17, 2009

(87) PCT Pub. No.: WO2008/055907

PCT Pub. Date: May 15, 2008

(65) Prior Publication Data

US 2010/0104061 A1 Apr. 29, 2010

(30) Foreign Application Priority Data

Nov. 8, 2006 (FR) ..... 06 54782

(51) Int. Cl.

| | |
|---|---|
| ***G21C 19/00*** | (2006.01) |
| ***G21F 7/005*** | (2006.01) |
| ***G21F 5/14*** | (2006.01) |
| ***G21F 5/12*** | (2006.01) |

(52) U.S. Cl.

CPC ..... *G21F 5/14* (2013.01); *G21Y 2004/40* (2013.01); *G21Y 2004/30* (2013.01); *G21F 7/005* (2013.01); *G21Y 2002/304* (2013.01); *G21Y 2002/501* (2013.01); *G21Y 2002/305* (2013.01); *G21F 5/12* (2013.01)

USPC ..... 376/272

(58) Field of Classification Search

CPC ..... G21F 5/12; G21F 5/02

USPC ..... 376/272

See application file for complete search history.

(56) References Cited

U.S. PATENT DOCUMENTS

| | | | | |
|---|---|---|---|---|
| 2,514,909 | A | 7/1950 | Strickland | |
| 3,710,121 | A * | 1/1973 | Bedrosian | 250/506.1 |

(Continued)

FOREIGN PATENT DOCUMENTS

| | | |
|---|---|---|
| FR | 2 806 828 | 9/2001 |
| JP | 54-008100 | 1/1979 |

(Continued)

OTHER PUBLICATIONS

Office Action (Notice of Reasons for Rejection) issued Dec. 25, 2012, in Japanese Patent Application No. 2009-535714 (and English translation thereof).

(Continued)

*Primary Examiner* — Jack W Keith
*Assistant Examiner* — Sharon M Davis
(74) *Attorney, Agent, or Firm* — Miles & Stockbridge P.C.

(57) ABSTRACT

The subject of the present invention is principally a transportation device for nuclear fuel which includes a compartment (2) to receive a casing loaded with irradiated fuel, the said compartment (2) including an opening (4) for loading and unloading of the casing (18) from the device and an opening (6) for applying a longitudinal force on the casing (18) causing it to move inside the compartment (2) in the direction of the unloading opening in order to unload it, through a force transmission component (32) which forms a biological shield.

14 Claims, 3 Drawing Sheets

(56) References Cited

U.S. PATENT DOCUMENTS

Figure 1:
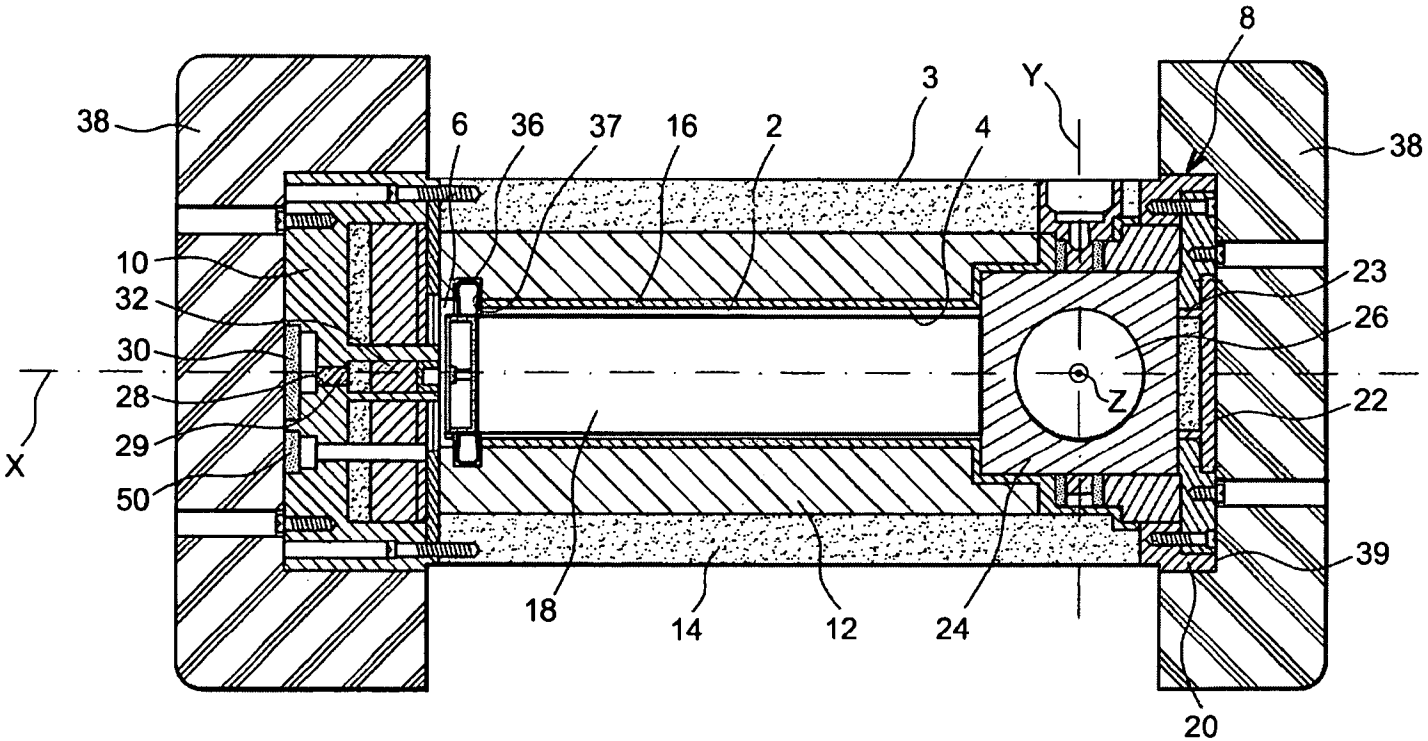

| | | | | | |
|---|---|---|---|---|---|
| 3,746,208 | A | * | 7/1973 | Hotz | 220/301 |
| 3,937,332 | A | * | 2/1976 | Flessner et al. | 414/745.2 |
| 4,081,688 | A | * | 3/1978 | Fries | 250/506.1 |
| 4,197,467 | A | | 4/1980 | Williams | |
| 4,450,134 | A | * | 5/1984 | Soot et al. | 376/262 |
| 4,732,527 | A | * | 3/1988 | Conche | 414/800 |
| 4,780,269 | A | | 10/1988 | Fischer et al. | |
| 5,150,843 | A | * | 9/1992 | Miller et al. | 241/27 |
| 5,406,600 | A | * | 4/1995 | Jones et al. | 376/272 |
| 5,438,597 | A | * | 8/1995 | Lehnert et al. | 376/272 |
| 6,114,710 | A | * | 9/2000 | Contrepois et al. | 250/506.1 |
| 2003/0010938 | A1 | | 1/2003 | Michels et al. | |

FOREIGN PATENT DOCUMENTS

| | | | |
|---|---|---|---|
| JP | 55-025208 | | 2/1980 |
| JP | 59-151098 | | 8/1984 |
| JP | 59-176642 | A | 10/1984 |
| JP | 04-233500 | | 8/1992 |
| JP | 09 236691 | A | 9/1997 |
| JP | 10-010289 | A | 1/1998 |
| JP | 2003-028987 | A | 1/2003 |

OTHER PUBLICATIONS

Office Action (Decision of Rejection) issued Mar. 4, 2014 in Japanese Patent Application No. 2009-535714, and English language translation.

* cited by examiner

DEVICE FOR THE TRANSPORTATION OF NUCLEAR FUEL AND METHOD FOR LOADING/UNLOADING OF THE SAID DEVICE

TECHNICAL FIELD AND EXISTING TECHNOLOGY

The present invention relates to the transportation of irradiated nuclear fuel, in particular between a cooling pond and a storage device.

The present invention relates in particular to transportation packaging which allows horizontal or vertical storage of the irradiated fuel contained in a casing.

In the context of irradiated fuel management, after being used in the reactor fuel is temporarily stored in a pond in a building, known as the fuel building, next to the reactor building.

The irradiated fuel is then removed to a temporary storage device to await its final release destiny, which may be reprocessing or storage.

Allowing for the capacity of storage ponds, an intermediate solution must be envisaged.

In this context, one could envisage placing the irradiated fuel in a metal casing forming the first containment barrier. Then the casing is placed inside metal packaging which forms a transportation device which provides mechanical protection for the casing and acts as a second confinement barrier during its transportation.

The transportation package minimises transfer of contamination during transportation of the casing loaded with nuclear fuel.

In order to place the nuclear fuel assemblies inside the casing and in the transportation packaging, one possibility is to use a so-called "hot" radiological shielding enclosure, with remote manipulation of the various components using manipulator arms: it is obvious that personnel cannot be located next to components with no radiological shielding. The drawback to this method is its cumbersomeness, and hence the timescales and the cost, both of the enclosure and of the tools and manipulation arms.

Another option is to carry out loading under water. Since water is, in fact, a good radiological shielding medium, and since all plants possess a pond, direct packaging of radioactive material in ponds has been proposed. In this context, the metal confinement casing is immersed in the pond and the fuel is loaded into it. The opening for loading the casing is then closed off using a plug, with this step taking place dry, as described in document FR 2 806 828. When and how this casing is placed in the transportation packaging is not described however.

Document U.S. Pat. No. 4,780,269 describes loading a casing in a pond, where the casing has been placed in transportation packaging beforehand. Thus the casing and the transportation packaging are simultaneously immersed. The casing is then closed using a plug in the pond and then the assembly formed by the packaging and the casing is withdrawn from the pond in order to close off the packaging and place it on the platform of a lorry in order to transport it to a storage area.

Two storage modes exist:

The first storage mode is storage in the vertical position, with the casings being arranged in wells. This storage mode results in significant space being saved, but its construction is very expensive, and is very cumbersome to implement. In effect, wells must be driven, foundations poured etc. Furthermore, legislation requires that it must be possible to recover nuclear fuels at any time. In the event, therefore, of a casing being damaged, the recovery of fuel from the bottom of the well would be very laborious.

The second storage mode is horizontal storage, where horizontal concrete housings are placed on a concrete frame, to which there is usually access from both ends.

Document U.S. Pat. No. 4,780,269 also describes transportation packaging and a storage device for horizontal storage of nuclear fuel casings. The transfer of the casing between the transportation packaging and the storage device is achieved using a piston. The side of the packaging which can be opened is made to face a first open end of the storage device, the piston then enters through a second open end of the storage device, opposite the first end of the storage device. The casing then leaves through the first end to enter the packaging. The free end of the piston or a winch then takes hold of the casing and exerts a traction force to bring it into the storage device.

The transfer of the casing to the storage module requires that the biological shielding plate be removed, so that continuity of biological shielding of the environment in relation to the casing is then broken.

Consequently, it is an aim of the present invention to provide a transportation device which is capable of forming a true biological barrier at all times in the transportation of the nuclear fuel.

It is also an aim of the present invention to provide a transportation device which allows packaging of irradiated nuclear fuel to take place in a pond.

It is also an aim of the present invention to provide a transportation device which allows safe and simple horizontal storage of a casing.

It is also an aim of the present invention to provide a transportation device which allows the casing to be recovered in order to store it in another location or reprocess it.

PRESENTATION OF THE INVENTION

The aims stated above are achieved by a transportation package which includes two axially opposite open ends which can be closed off using plugs. A first end allowing the casing to be loaded/unloaded and a second end allowing means to pass through it which are designed to apply a thrust/traction force on the casing, whilst ensuring continuity of biological shielding. The plug which closes off the end opposite that for loading/unloading includes a passage which is equipped with a force transmission component which forms a biological barrier.

In other words, a composite plug is constructed whose central part can move with the loading/unloading device by fitting between the loading/unloading device and the casing, whilst maintaining a biological barrier throughout the loading/unloading phase.

In the horizontal position the first end can come up against an opening to allow a casing filled with fuel to be loaded/unloaded in a storage device. At the other end, a piston rod for unloading the packaging applies a thrust/traction force on a longitudinal end of the casing through the said force transmission component.

Thus continuity of the biological shield is ensured.

Furthermore, the design of the transportation device according to the invention renders it especially suitable for loading in ponds, by allowing a casing filled with used fuel to be loaded underwater and allowing the various operations for closing and sealing the casing to be carried out.

In effect, an inflatable seal fitted between the compartment and the casing to be loaded into the packaging limits the transfer of contamination due to the casing. Additionally, it is advantageously arranged that the difference between the height of the opening in the packaging and that in the casing is sufficient to allow the operations for closing and sealing the casing to be carried out using an automatic system. A system for draining may also be fitted.

The transportation device therefore serves as a biological shield and mechanical protection system and ensures safe transfer of the casing into a storage device.

The main subject-matter of the present invention is therefore a device for the transportation of nuclear fuels which comprises a barrel with a longitudinal axis which forms a compartment designed to contain a casing loaded with nuclear fuel, where the said compartment is equipped at a first longitudinal end with a first opening closed off by means of a closure device and designed to allow the casing to pass through, and a second opening closed off by a plug, where the said plug includes a through passage and a component for transmitting force which forms a biological shield fitted so that it slides in the said passage, with the said passage being designed to allow a loading/unloading device to apply a thrust force on the casing along a longitudinal direction in the direction of the first opening in order to unload a casing, or a traction force in the direction of the second opening in order to load the casing into the transportation device.

In one example of a construction option, the passage in the plug in the second opening is closed off on the outside by a door and on the inside by the force transmission component, where the said component is designed to slide inside the compartment.

The component is, for example, a massive cylindrical component which fits the diameter of the passage and that of the compartment.

A sealing system is advantageously fitted between the force transmission component and the passage through the plug.

The force transmission component may include a gripper which hooks onto the casing automatically in order to transmit a traction force onto the latter.

In one particularly advantageous example, the means of closing off the first opening includes a first plug on the outside and an additional plug on the inside, with the additional plug forming a biological barrier when the first plug is withdrawn.

The additional plug may be fitted so that it can rotate around an axis which is orthogonal to the longitudinal axis, and includes a passage with a longitudinal axis whose diameter is such that it allows the casing to pass through and is arranged in such a manner that one rotation of the additional plug around the axis of rotation results in the axis of passage in the additional plug being in alignment with the axis of the compartment, so that the casing may pass through the additional plug.

An inflatable seal may be fitted onto an interior wall of the compartment towards the said component, which is designed to come into contact with the casing.

Advantageously the transportation device includes shock absorbing caps which cover the longitudinal ends of the said transportation device.

A system for checking that the compartment is sealed which includes a means for injecting helium between two concentric seals between the plug and the barrel or between the door and the plug may be fitted, where one of the seals is radially internal and the other seal is an intermediate seal, and a means of detecting the presence of helium in the intermediate seal and a radially external seal.

Another subject of the present invention is a loading/unloading device which uses the transportation device according to any of the preceding claims, which includes a piston designed to enter the passage through the plug and to exert a thrust or traction force on the force transmission component.

The loading/unloading device may include a sealing system designed to ensure that there is a seal between the piston and the cover.

The loading/unloading device may also include means of fastening the piston onto the force transmission component.

Another subject of the present invention is a method for the unloading from a transportation device according to the present invention, of a casing loaded with nuclear fuel, where the said method includes a step in which a thrust force is applied from the second opening in the direction of the first opening so that the casing is made to slide in the device towards the first opening causing the casing to emerge from the said transportation device.

Another subject of the present invention is a method for the unloading of a transportation device according to the present invention, with a casing loaded with nuclear fuel, where the said method includes a step in which a traction force is applied from the first opening in the direction of the second opening so that the casing is made to slide inside the transportation device.

BRIEF DESCRIPTION OF THE DIAGRAMS

Figure 2A:
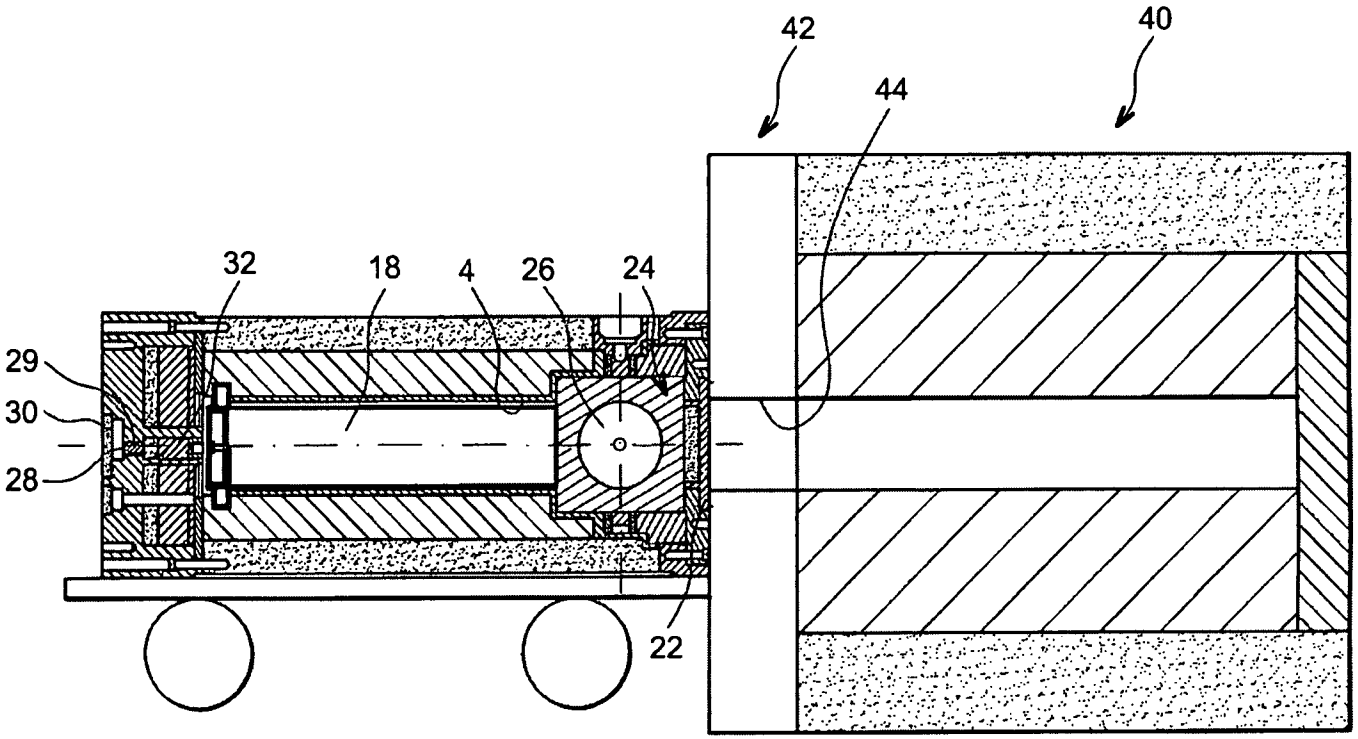
Figure 2B:
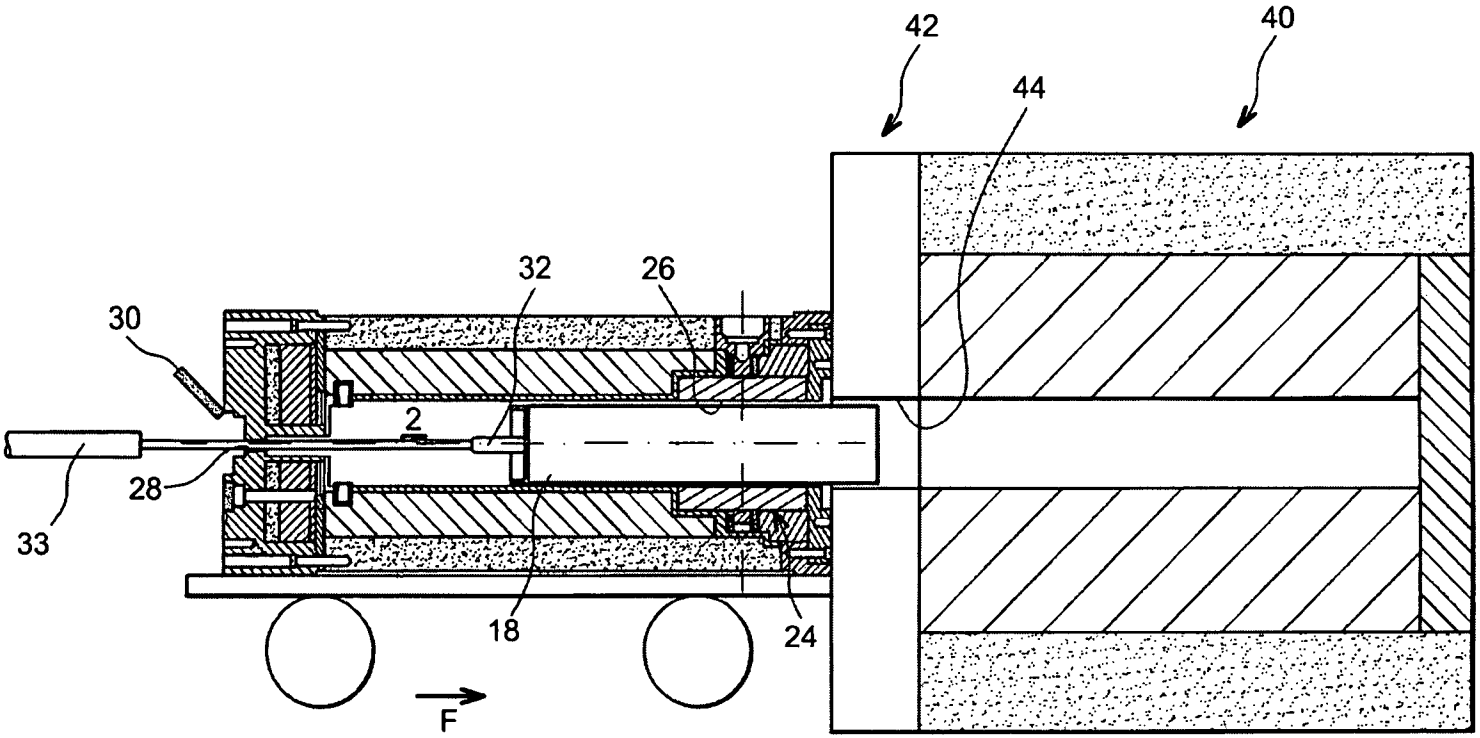

The present invention will be more clearly understood with the help of the following description and the appended diagrams, in which:

FIG. 1 is a longitudinal section view of a transportation device according to the present invention, FIGS. 2A and 2B are schematic representations of, respectively, loading and unloading steps for the transportation device according to the present invention.

DETAILED DESCRIPTION OF SPECIFIC CONSTRUCTION OPTIONS

In FIG. 1, one can see an example of a construction option for a device according to the present invention, which includes a chamber 2 with an axis X called the compartment which is designed to receive a casing 18, inside a cylindrical barrel 3. The compartment 2 includes a first longitudinal opening 4 and a second longitudinal opening 6 closed off respectively by a first plug 8 and a second plug 10.

The first and second plugs 8 and 10 include openings which are designed to allow the object which will be described below to pass through.

The barrel 3 includes, in an advantageous manner, a first internal cylinder 12 made of steel and a second external cylinder 14 made of resin. It could be envisaged that the cylinder be made entirely of steel.

The barrel 3 also includes an internal sleeve 16 which covers the internal wall of the internal cylinder 12. Sealing between the internal sleeve 16 and the internal cylinder 12 is achieved using welding during the construction of the packaging.

A casing 18 loaded with nuclear fuel, in particular irradiated nuclear fuel, is placed inside the sleeve 16, for example under water in a cooling pond.

The first opening 4 is designed to allow the casing 18 to pass through it when it is loaded into the transportation device and when it is being unloaded to a storage module.

The first plug 8 closing off the opening 4 includes an external collar 20 fixed to the barrel 3, and a first central plug 22, which is itself fixed to the collar 20. Fastening is achieved, for example, using a threaded fixing.

The collar 20 includes a central opening 23 which is closed off by the first plug 22, with this opening 23 allowing the casing 18 to pass through.

In a highly advantageous manner, an additional plug 24 is fitted towards the loading/unloading opening, forming a biological barrier once the central plug 22 has been withdrawn.

The additional plug 24 has an essentially cylindrical form fitted so as to rotate around its axis Y, where the axis Y is aligned with a diameter of the barrel 3 and is orthogonal to the axis X. The additional plug 24 includes a cylindrical passage 26 with a diameter designed to allow the casing 18 to pass through and whose axis Z is orthogonal to the axis Y.

In the closed-off position, as shown in FIG. 1, the axis Z of the passage 26 is orthogonal to the axis X of the compartment 2, preventing passage and forming a biological barrier.

In the loading or unloading positions, the axis Z of the passage 26 is aligned with the axis X of the compartment 2, so that passage 26 is an extension of the compartment 2, and allows loading or unloading of the casing which slides inside the passage 26 and inside the compartment 2.

The additional plug 24 is operated, for example manually, from the outside of the packaging.

According to the present invention the plug 10 which closes off the second opening 6 includes an axial through passage 28 closed off by a door 30, and a force transmission component 32 which is designed to slide in the central passage 28 and inside the compartment 2. This component 32 forms a biological barrier.

The passage may also include a plug 29 which forms an additional biological shield between the door 30 and the force transmission component 32.

The component 32 can slide inside the passage 28 and emerge into the compartment 2. Thus, by applying a thrust force onto the component 32 in the direction of the first opening 4, the casing 18 can be made to slide inside the compartment 2.

The component 32 acts as a push rod during unloading and as a traction device during loading. The force transmission component 32 includes a massive cylindrical component which fits the diameter of the passage 30 and of the compartment 2, and which forms, as stated above, a biological shield.

The component 32 advantageously includes, at the end which is designed to come into contact with the casing, a cavity (not shown) which allows it to automatically align with the casing when a thrust force is applied.

In one example of a construction option, the component 32 includes a gripper, formed of two or three fingers, designed to connect automatically onto the casing. Thus in the case of loading of the packaging, the component 32 can exert a traction force on the casing.

One can envisage the free end of a piston 33 (FIG. 2*b*) entering the passage 28 when the door 30 is open.

It is envisaged that the free end of the piston 33 is fixed onto the component 32, so that when the casing 18 is removed from the compartment 2, the component 32 is brought into its at-rest position when the piston 33 is retracted.

The link between the component 32 and the piston rod is achieved, for example, using a nut and bolt system. The link between the piston 33 and the force transmission component 32 is made when the closure door 30 is open.

The axial dimension of the piston 33 is therefore designed to allow the casing 18 to slide completely out of the compartment 2.

One could envisage the casing 18 being pushed directly using the piston 33, but placing the component 32 between them provides, as described earlier, an additional biological shield for the individuals who are operating the piston 33.

It is also advantageous if a sealing system (not shown) is fitted between the body of the piston and the external face of the plug 10, in order to ensure confinement of the piston-packaging assembly in relation to the exterior.

When the piston is fitted to the plug 10, the piston rod 33 enters the passage 28 and connects directly onto the component 32.

The transportation device according to the invention advantageously includes an inflatable seal 36 placed in a groove 37 made in the internal wall of the compartment 2 towards the second end 6. This comes into contact with the body of the casing 18 and provides confinement of the casing 18 by forming a barrier at a lateral gap between the compartment 2 and the body of the casing 18, so that during loading of the transportation device with a casing in a pond, water does not enter the gap between the casing and the wall of the compartment 2.

The persons who operate the piston are completely shielded from any radiation emitted by the fuel contained in the casing and which is not stopped by the casing.

It is also envisaged in the example shown that the difference in height between the opening in the packaging and that in the casing is sufficient to allow operations to close and seal the casing in the pond to take place using an automatic system.

Means for ensuring a seal are also fitted between the various components which make up the transportation device, in particular between the collar 20 and the barrel 3, between the first plug 22 and the collar 20, between the plug 10 and the barrel 3 and between the component 32 and the plug 10. As an example, three concentric O-ring seals may be fitted between the door 30 and the plug 10, or similarly between the plug 10 and the barrel 3.

This arrangement also enables a rapid check on the confinement of the packaging to be carried out.

Component 32 includes peripheral seals (not shown), so that for example the risk of transferring contamination during translation movement of the piston is minimised. These seals, for example O-rings and two in number, fitted to the piston, thus ensure that there is a seal between the plug 10 and the component 32.

The confinement of the casing is achieved through the various barriers formed by the fuel sheathing, the welding of the casing and the seals made of synthetic materials which ensure that the transportation device is sealed.

Also fitted to the transportation device is a system (not shown) for checking that the packaging is sealed. For example, a sampling point equipped with a self-closing rapid connector protected by a sealed door is fitted in the cover 10 and this allows the interior of the packaging to be checked.

The sealing of this sample point is provided by a door 50 equipped with two O-rings in series.

This system may include:

- a point for injecting helium located between two seals of the three seals placed between the door 30 and the plug 10 or between the plug 10 and the barrel 3, where one of the seals is the seal which is radially the furthest towards the interior and the other seal being an intermediate seal.
- A second measurement point to which a helium detector is connected; this point is placed, for example, between the intermediate seal and the third seal which is radially the furthest towards the exterior.

Thus if helium is detected between the intermediate seal and the third seal this indicates that the intermediate seal is not leak-tight.

In a preferred example, protective caps 38 are fitted which are designed to cover and surround the longitudinal ends of the barrel 3 in order to protect them in the event of an impact. These caps 38 take the form of a cylinder equipped with a central cavity 39 whose internal diameter is effectively equal to the external diameter of the barrel 3. The cavities 39 are fitted onto the longitudinal ends of the barrel 3, and the caps are fixed, for example using bolts, to the plugs 8, 10. These caps protect the sealing systems.

These caps are removed during loading or unloading of the casing from the transportation device, in order to allow the door 30 to be removed.

This device therefore allows the transportation packaging either to be unloaded by transfer of the casing into the storage device, or allows the casing to be removed from the storage device into the transportation packaging.

The set of sealing systems used, in particular between the piston body and the packaging and that of the push-rod 32 fitted with its grips means that the sealing integrity of the packaging as well as biological shielding can be preserved.

We will now describe the unloading of a casing contained in a transportation device according to the present invention, based on FIGS. 2A and 2B.

The transportation device arrives on the unloading site; it is usually transported in a laid-down position and ready for unloading.

The shock absorbing caps 38 are then removed.

The first end 4 of the device is aligned with an inlet 44 to a receiving enclosure 40 for horizontal storage of the casing 18. Means 42 are placed between the first end of the transportation device and the inlet 44 to the enclosure 40 in order to withdraw the first plug 22 and to ensure the permanent confinement of the casing 18 (FIG. 2A).

The rest of the unloading method is represented in FIG. 2B:

the first plug 22 is withdrawn, the additional plug 24 is pivoted around the axis Y so as to align the passage 26 with the compartment 2.

the door 30 is opened; if a plug 29 is fitted, then this is removed, the piston is fixed and sealed onto the plug 10 and the free end of the piston 33 is fixed onto the rear face of the push-rod 32. The piston is then operated. The component 32 transmits the thrust force to the casing 18 in the direction of the arrow F, the casing 18 slides in the compartment 2, enters into the passage 26 in the additional plug 24, then into the receiving enclosure 40.

The piston is operated until the casing 18 is completely within the enclosure 40.

The piston 33 is then retracted, bringing the component 32 to its at-rest position inside the plug 8.

When the piston has emerged completely from the device, the door 30 is closed once more.

The additional plug 24 pivots to return to its at-rest position in which the axis Z of the passage 26 is orthogonal to that of the compartment 2.

The first plug 22 is refitted in place in the collar 20.

Loading from the receiving enclosure, is carried out in a similar manner by applying a traction force to the component 32 which pulls on the casing causing it to enter into the compartment 2.

The storage device includes an inlet 44 for the casing to pass through and an end 46 for the piston to pass through so that it may apply a thrust force on the casing. The transfer is carried out in a manner which is equivalent to unloading of the device according to the invention described earlier.

Throughout the unloading or loading phases, leak-tightness towards the exterior is maintained by means of the sealing systems described above.

The invention claimed is:

1. A device for the transportation of nuclear fuels, comprising:

a barrel with a longitudinal axis which forms a compartment designed to contain a casing loaded with nuclear fuel, said compartment being equipped, at a first longitudinal end, with a first opening which is closed off by a closure device, and is constructed to allow passage of the casing, and at a second longitudinal end with a second opening closed off by a plug which includes a through passage and a force transmission component, wherein said force transmission component forms a biological shield adapted for slidable movement in said through passage of said plug, wherein said force transmission component is constructed to exert a thrust force on the casing, wherein said through passage is constructed to allow a loading/unloading device to apply, respectively, a thrust force on the casing through the force transmission component, along a longitudinal direction in a direction of the first opening in order to unload a casing, or a traction force in a direction of the second opening in order to load the casing into the transportation device, wherein said force transmission component is a separate structure from said loading/unloading device, said force transmission component having first and second ends, wherein said first end of said force transmission component is adapted to be detachably connected with said loading/unloading device, wherein said force transmission component is arranged with respect to said through passage such that said second end of said force transmission component contacts said casing in response to receiving said thrust force via said loading/unloading device, and wherein said through passage of said plug is adapted to sealingly retain said force transmission component inside said through passage, and said force transmission component forms a center portion of said plug, when said thrust force is not being applied.

2. The device according to claim 1, wherein the through passage of the plug in the second opening is closed off to an outside of the device by a door and to an inside of the device by the force transmission component, said component being adapted to slide inside the compartment.

3. The device according to claim 2, further comprising:

a system for checking that the compartment is sealed, said system for checking including means for injecting helium between two concentric seals disposed between the plug and the barrel or between the door and the plug, wherein one of the seals is radially internal and another seal is an intermediate seal, and means for detecting the presence of helium in the intermediate seal and a radially external seal.

4. The device according to claim 1, wherein said component includes a massive cylindrical component which fits a diameter of the through passage and a diameter of the compartment, wherein the compartment forms a biological shield, and wherein a sealing system is fitted between said component and the through passage through the plug.

5. The device according to claim 1, wherein said force transmission component includes a gripper at said second end which attaches to the casing automatically to transfer a traction force onto the casing.

6. The device according to claim 1, wherein said closure device closing off the first opening includes a first plug on the outside and an additional plug on the inside, the additional plug forming a biological barrier when the first plug is withdrawn.

7. The device according to claim 6, wherein the additional plug is adapted to rotate around an axis which is orthogonal to the longitudinal axis, and wherein said additional plug includes a passage with a longitudinal axis and said additional plug has a diameter which allows the casing to pass through and which is arranged in such a manner that a rotation of the additional plug around the axis of rotation results in the axis of passage of the additional plug being aligned with the axis of the compartment, thereby allowing the casing to pass through the additional plug.

8. The device according to claim 1, further comprising:

an inflatable seal disposed on an interior wall of the compartment proximate to said component and which is designed to come into contact with the casing.

9. The device according to claim 8, further comprising:

a plurality of shock absorbing caps which cover longitudinal ends of said transportation device.

10. The device of claim 1, wherein said through passage and said force transmission component each have a circular cross-section in a direction perpendicular to said longitudinal direction.

11. A method for unloading from a transportation device a casing loaded with nuclear fuel, said transportation device including a barrel with a longitudinal axis which forms a compartment designed to contain a casing loaded with nuclear fuel, said compartment being equipped, at a first longitudinal end, with a first opening which is closed off by a closure device and which is designed to allow passage of the casing, and at a second longitudinal end with a second opening closed off by a plug which includes a through passage and a force transmission component which forms a biological shield fitted to slide in said through passage of said plug, said force transmission component being designed to exert a thrust force on the casing, said through passage being designed to allow a loading/unloading device to apply, respectively, a thrust force on the casing through the force transmission component, along a longitudinal direction in a direction of the first opening to unload a casing, or a traction force in a direction of the second opening to load the casing into the transportation device, said method comprising:

opening the closure device; and applying a thrust force, using the force transmission component, from the second opening in the direction of the first opening so that the casing is made to slide in the device towards the first opening, thereby causing the casing to emerge from said transportation device, wherein said force transmission component is a separate structure from said loading/unloading device, said force transmission component having first and second ends, wherein said first end of said force transmission component is adapted to be detachably connected with said loading/unloading device, wherein said force transmission component is arranged with respect to said through passage such that said second end of said force transmission component contacts said casing in response to receiving said thrust force via said loading/unloading device, and wherein said through passage of said plug is adapted to sealingly retain said force transmission component inside said through passage, and said force transmission component forms a center portion of said plug, when said thrust force is not being applied.

12. The method of claim 11, wherein said through passage and said force transmission component each have a circular cross-section in a direction perpendicular to said longitudinal direction.

13. A method for loading a transportation device with a casing loaded with nuclear fuel, said transportation device including a barrel with a longitudinal axis which forms a compartment designed to contain a casing loaded with nuclear fuel, said compartment being equipped, at a first longitudinal end, with a first opening which is closed off by a closure device and which is designed to allow passage of the casing, and at a second longitudinal end with a second opening closed off by a plug which includes a through passage and a force transmission component which forms a biological shield fitted to slide in said through passage of said plug, said force transmission component being designed to exert a thrust force on the casing, said through passage being designed to allow a loading/unloading device to apply, respectively, a thrust force on the casing through the force transmission component, along a longitudinal direction in a direction of the first opening to unload a casing, or a traction force in a direction of the second opening to load the casing into the transportation device, said method comprising:

opening the closure device;

applying a thrust force, using the force transmission component, from the second opening in the direction of the first opening so that the force transmission component grippingly engages with said casing; and applying a traction force, using the force transmission component, from the first opening in the direction of the second opening so that the casing is made to slide inside the transportation device, wherein said force transmission component is a separate structure from said loading/unloading device, said force transmission component having first and second ends, wherein said first end of said force transmission component is adapted to be detachably connected with said loading/unloading device, wherein said second end of said force transmission component includes a gripper adapted to be detachably connected with said casing, wherein said force transmission component is arranged with respect to said through passage such that said second end of said force transmission component grippingly engages with said casing in response to receiving said thrust force via said loading/unloading device, and wherein said through passage of said plug is adapted to sealingly retain said force transmission component inside said through passage, and said force transmission component forms a center portion of said plug, when said thrust force is not being applied.

14. The method of claim 13, wherein said through passage and said force transmission component each have a circular cross-section in a direction perpendicular to said longitudinal direction.

* * * * *